US008154180B1

(12) United States Patent
Tsao

(10) Patent No.: US 8,154,180 B1
(45) Date of Patent: Apr. 10, 2012

(54) LIGHT-EMITTING DIODE LAMP

(75) Inventor: Chia-Tsung Tsao, Taipei (TW)

(73) Assignee: Artled Technology Corp., Taipei Hsien (TW)

( * ) Notice: Subject to any disclaimer, the term of this patent is extended or adjusted under 35 U.S.C. 154(b) by 52 days.

(21) Appl. No.: 12/911,869

(22) Filed: Oct. 26, 2010

(51) Int. Cl.
*H01K 1/58* (2006.01)

(52) U.S. Cl. ..... 313/46; 313/317; 362/373

(58) Field of Classification Search ..... 313/46, 313/318.01, 324, 512; 362/249.01, 249.02, 362/364, 373, 375
See application file for complete search history.

(56) References Cited

U.S. PATENT DOCUMENTS

| | | | | |
|---|---|---|---|---|
| 8,093,790 | B1 * | 1/2012 | Tsao | 313/46 |
| 2004/0213016 | A1 * | 10/2004 | Rice | 362/547 |
| 2008/0186704 | A1 * | 8/2008 | Chou et al. | 362/249 |
| 2009/0040759 | A1 * | 2/2009 | Zhang et al. | 362/249 |
| 2009/0225555 | A1 * | 9/2009 | Ghim et al. | 362/373 |
| 2009/0237932 | A1 * | 9/2009 | Lee | 362/249.02 |
| 2010/0177521 | A1 * | 7/2010 | Lee | 362/373 |
| 2010/0259942 | A1 * | 10/2010 | Lee | 362/373 |
| 2011/0309734 | A1 * | 12/2011 | Lin et al. | 313/46 |

* cited by examiner

*Primary Examiner* — Bumsuk Won
(74) *Attorney, Agent, or Firm* — Rabin & Berdo, P.C.

(57) ABSTRACT

An LED lamp having a heat-dissipating mechanism has a top casing, a heat-conducting tube and a bottom casing. The top casing has a foundation board, a lamp holder and multiple fins. The foundation board has a first tube guide formed around and protruding downwardly from a perimeter of the foundation board and is made of a metal material. The lamp holder is hollow and centrally mounted through the top casing, and has a second tube guide formed on a bottom thereof. The fins are radially formed on a top of the foundation board and around the lamp holder. The heat-conducting tube is mounted against one side of the first tube guide and within the second tube guide. The bottom casing is securely combined with the top casing. Besides the fins, the heat-conducting tube enlarges the contact area with the top casing, thereby enhancing the heat-dissipating efficiency.

16 Claims, 6 Drawing Sheets

LIGHT-EMITTING DIODE LAMP

BACKGROUND OF THE INVENTION

1. Field of the Invention

The present invention relates to a light-emitting diode (LED) lamp, and more particularly to an LED lamp having a heat-dissipating mechanism for enhancing the heat-dissipating efficiency of the LED lamp.

2. Description of the Related Art

With reference to FIG. 6, a conventional LED lamp has a top casing 91, a bottom casing 92, a chamber, a circuit board, a power conversion module and an electrical contact portion 97. The top casing 91 has a lamp holder 93 and multiple LED bulbs 95. The lamp holder 93 is centrally formed on the top casing 91. The LED bulbs 95 are mounted on the lamp holder 93. The bottom casing 92 has multiple fins 96 longitudinally formed around a periphery of the bottom casing 92 for dissipating the heat generated from the LED lamp. The chamber is defined by the top casing 91 and the bottom casing 92. The circuit board and the power conversion module are mounted in the chamber. The electrical contact portion 97 is connected with an external power source or AC mains.

The fins 96 on the aforementioned LED lamp are the only heat-dissipating mechanism to transfer heat generated by the LED lamp to a surrounding environment. Therefore, the cooling effect is not so significant. In turn, the heat-dissipating performance of the conventional LED lamp still has to be improved.

SUMMARY OF THE INVENTION

An objective of the present invention is to provide an LED lamp having a heat-dissipating mechanism to enhance the heat-dissipating efficiency.

To achieve the foregoing objective, the LED lamp has a top casing, a heat-conducting tube and a bottom casing.

The top casing has a foundation board, a lamp holder, multiple fins and multiple LED bulbs. The foundation board has a front and at least one first tube guide formed around and protruding from a perimeter of the foundation board, and is made of metal. The lamp holder is hollow and centrally mounted through the top casing, extends toward both an upward direction and a downward direction, and has a front, a rear, an opening, a base and a second tube guide. The opening is formed through the front of the lamp holder. The base is formed on the rear of the lamp holder and has a rear. The second tube guide is U-shaped and formed on the rear of the base. The fins are radially formed on the front of the foundation board and around the lamp holder. The LED bulbs are mounted in the lamp holder.

The heat-conducting tube is bendable and is mounted against one side of each one of the at least one first tube guide and within the second tube guide.

The bottom casing is recessed and securely combined with the top casing.

In addition to the fins formed on the foundation board and around the lamp holder to dissipate the heat generated inside the lamp holder, the LED lamp of the present invention further employs the heat-conducting tube and the at least one first tube guide and the second tube guide for heat dissipation. As the at least one first tube guide and the second tube guide are respectively formed on the foundation board and the lamp holder and the heat conducting tube is attached to both of the at least first tube guide and the second tube guide, the contact area for transferring heat is enlarged, thereby enhancing the heat-dissipating efficiency of the LED lamp.

Other objectives, advantages and novel features of the invention will become more apparent from the following detailed description when taken in conjunction with the accompanying drawings.

DETAILED DESCRIPTION OF THE INVENTION

Figure 1:
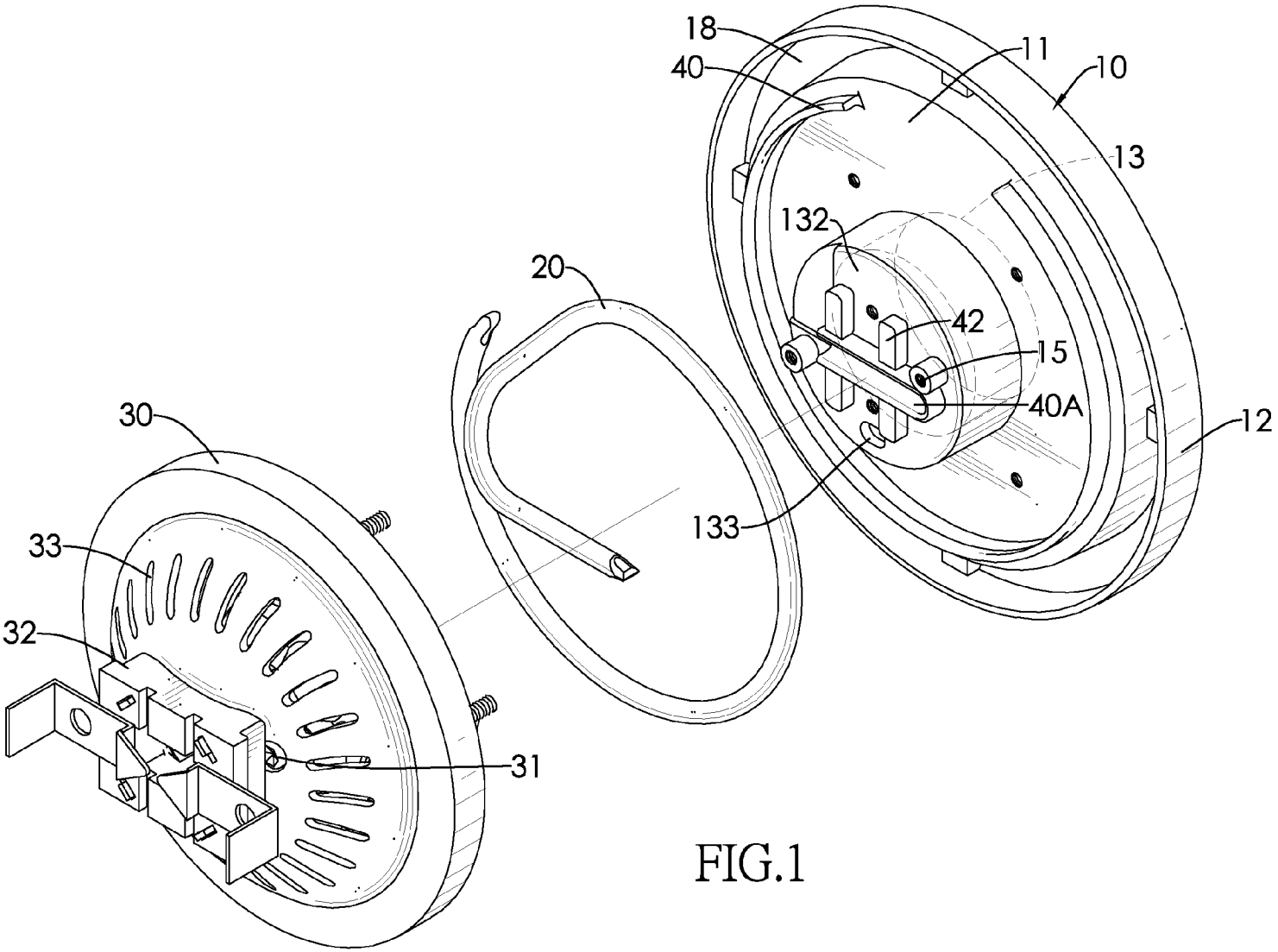
FIG. 1 is an exploded perspective view of an embodiment of an LED lamp in accordance with the present invention.
Figure 2:
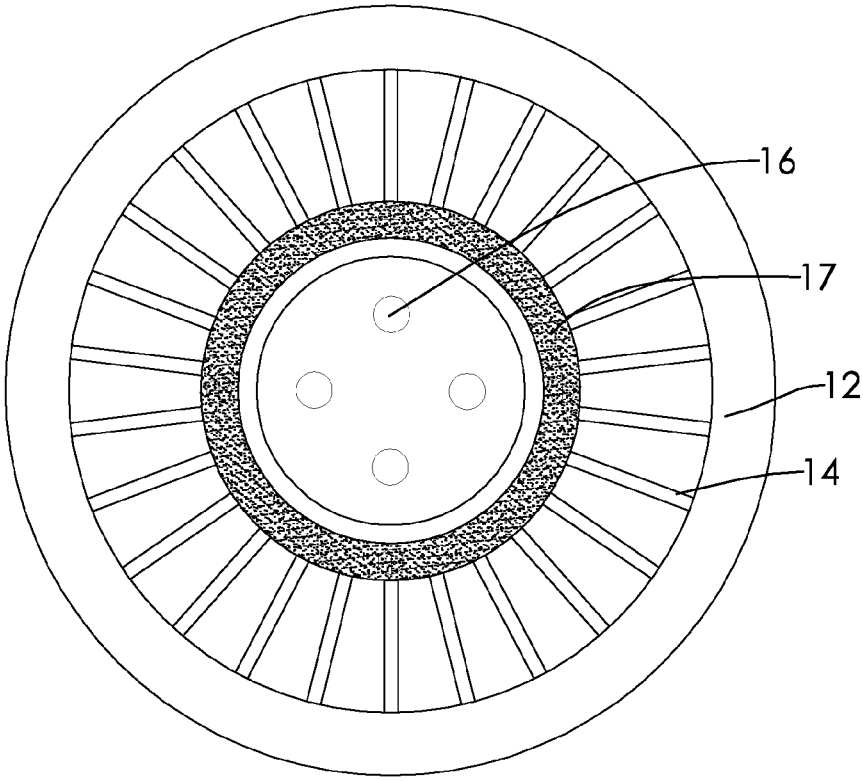
FIG. 2 is a front view of the LED lamp in FIG. 1.
Figure 3:
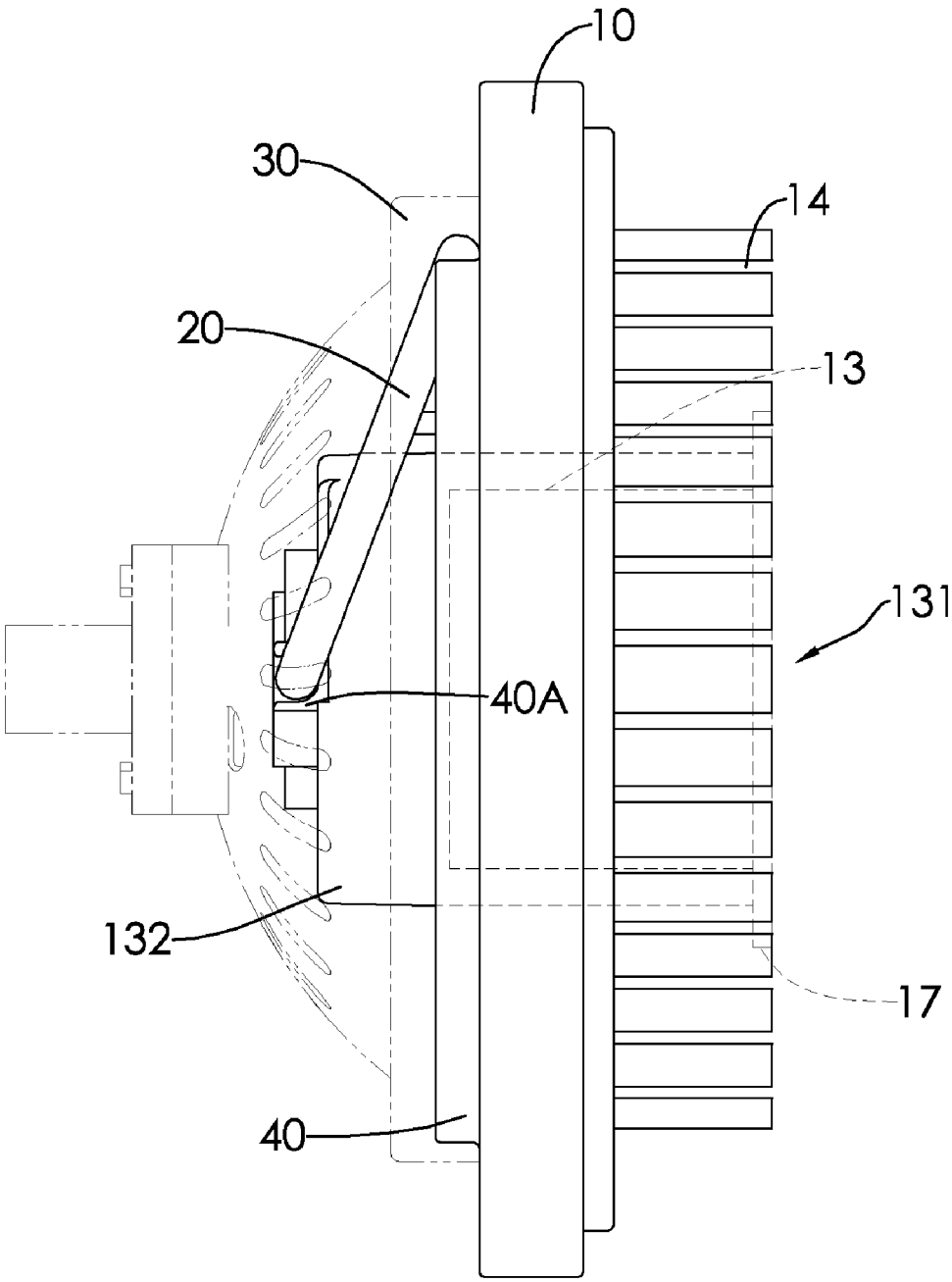
FIG. 3 is a side view of the LED lamp in FIG. 1.

With reference to FIGS. 1 to 3, an LED lamp in accordance with the present invention has a top casing 10, a heat-conducting tube 20 and a bottom casing 30.

The top casing 10 has a foundation board 11, a peripheral wall 12, a lamp holder 13, multiple fins 14, multiple LED bulbs 16, an anti-glare sleeve 17 and multiple fixing holes15. The Foundation board 11 has at least one first tube guide 40, and is made of metal, such as aluminum. The at least one first tube guide 40 is formed around and protrudes from a part of a perimeter of the foundation board 11. The peripheral wall 12 is hollow and is formed around and protrudes from a perimeter of a front of the top casing 10. The lamp holder 13 is cylindrical, hollow and centrally formed on the foundation board 11, extends toward both a forward direction and a backward direction, and has an opening 131, a base 132, a through hole 133, a second tube guide 40A and multiple heat-conducting blocks 42. The opening 131 is formed through a front of the lamp holder 13. The base 132 is formed on a rear of the lamp holder 13. The through hole 133 is formed through the base 132 for wires to mount through. The second tube guide 40A is U-shaped, and is formed on a rear of the base 132. The heat-conducting blocks 42 are mounted on the rear of the base 142 and are connected with the second tube guide 40A. The fins 14 are radially formed on, protrude from a front of the foundation board 11, and are located between the peripheral wall 12 and the opening 131 and around the lamp holder 13, and protrude forwardly from the foundation board 11 to dissipate heat generated from the lamp holder 13. The LED bulbs 16 are mounted on the front of the base 132, and the LED bulbs 16 and multiple components required by the LED bulbs 16 are received inside the lamp holder 13. The anti-glare sleeve 17 is securely mounted in the opening 131 and on an inner wall of the lamp holder 13, and is covered with a coating having a dark color to absorb and reduce the glare generated by the LED bulbs 16. The fixing holes 15 are respectively formed through the base 132 of the lamp holder 13.

Figure 4:
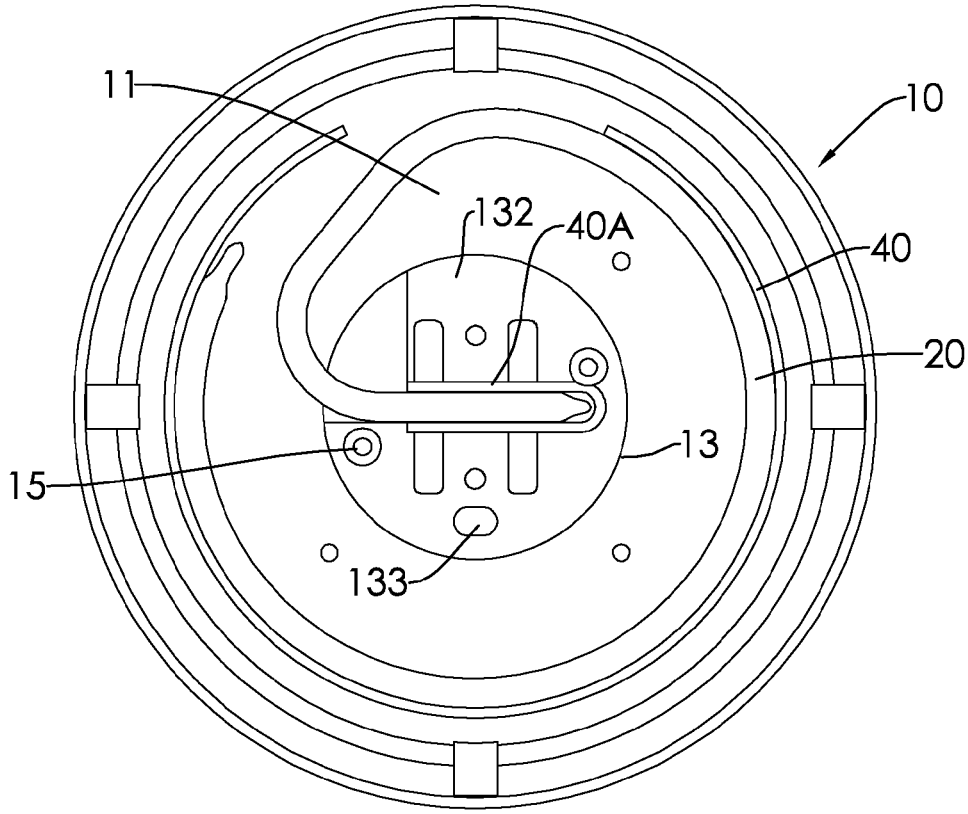
FIG. 4 is a rear view of a top casing and a heat-conducting tube of the LED lamp in FIG. 1.

With reference to FIG. 4, the heat-conducting tube 20 is bendable to correspond to shapes of the at least one first tube guide 40 and the second tube guide 40A so that the heat-conducting tube 20 can be mounted against one side of each one of the at least one first tube guide 40 and within each one of the second tube guide 40A. As a contact area between the heat-conducting tube 20 and the top casing 10 enlarges, the heat-dissipating efficiency is enhanced accordingly.

The bottom casing 30 is recessed rearwardly and has multiple fixing holes 31, two electrodes 32 and multiple heat-dissipation holes 33. The fixing holes 31 are formed through the bottom casing 30 to correspond to and align with the fixing holes 15 of the top casing 10. The bottom casing 30 can be combined securely with the top casing 10 by multiple fasteners mounted respectively through the corresponding fixing holes 15, 31. The electrodes 32 are mounted on a bottom of the bottom casing 30. One end of each electrode 32 is connected to the LED bulbs and the components required by the LED bulbs. The other end of each electrode 32 is connected to an external power source or the AC mains. The heat-dissipation holes 33 are radially formed through the bottom casing for dissipating heat radiated from the heat-conducting tube 20.

Figure 5:
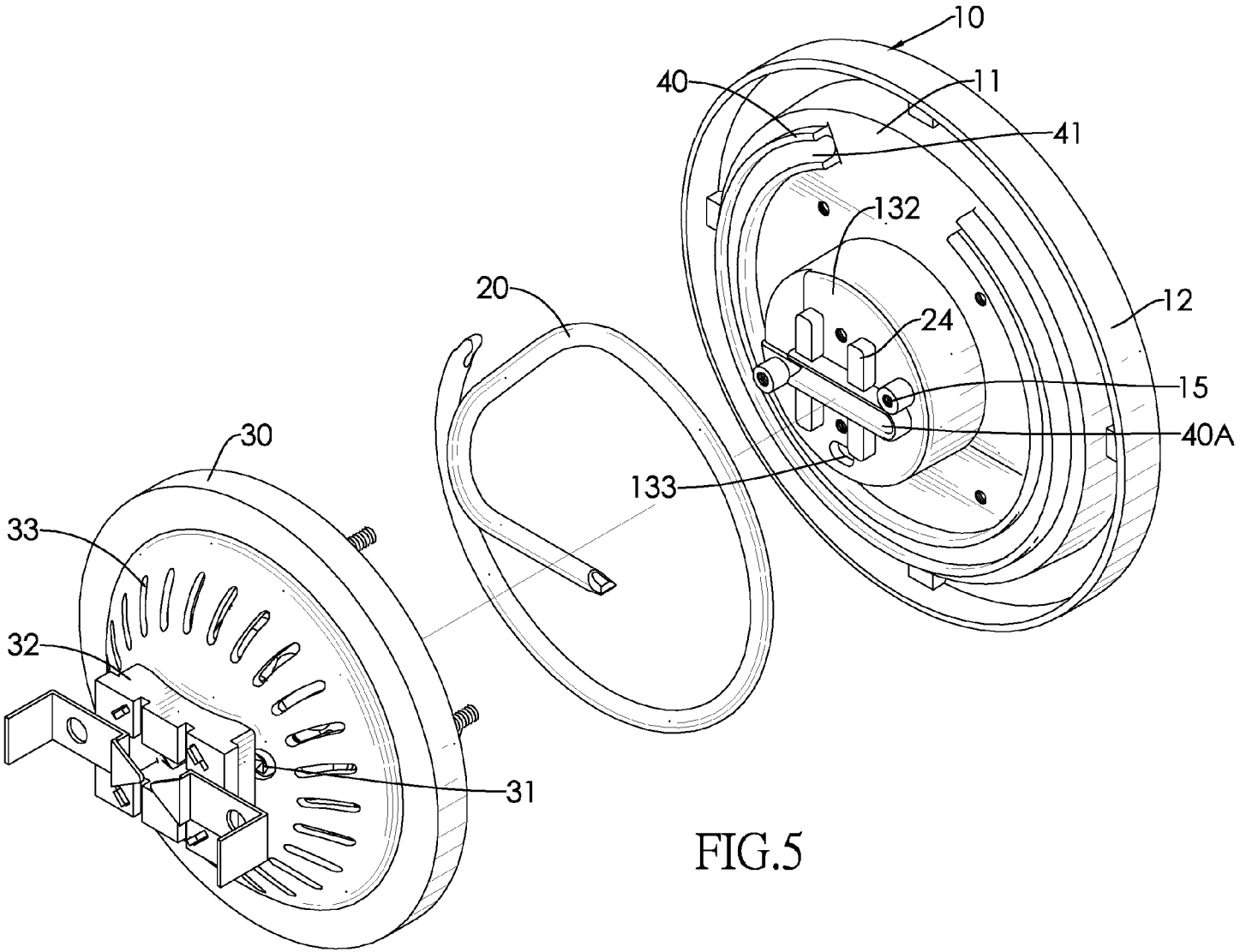
FIG. 5 is an exploded perspective view of another embodiment of the LED lamp in accordance with the present invention.
Figure 6:
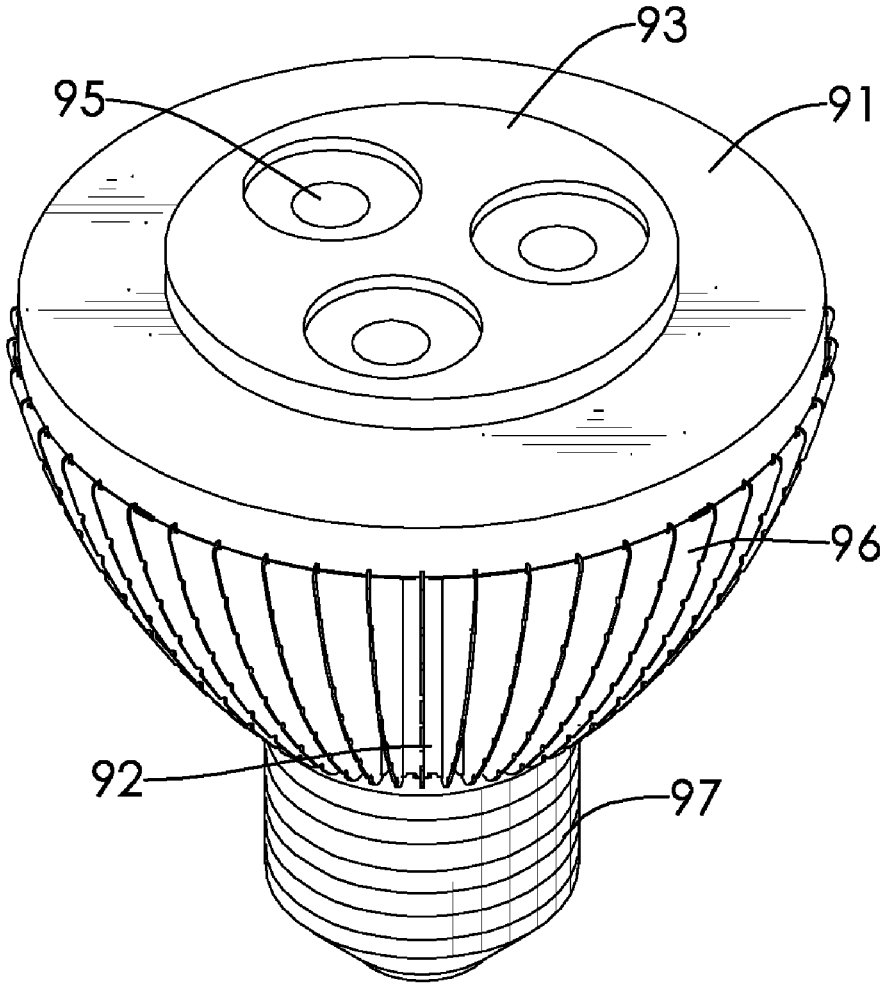
FIG.6 PRIOR ART
FIG. 6 is a perspective view of a conventional LED lamp.

With reference to FIG. 5, another embodiment of the LED lamp has two first tube guides 40 and a groove 41. The two first tube guides 40 are formed around and protrude downwardly from a part of a perimeter of the foundation board 11. The groove 41 is formed between the two first tube guides 40. The heat-conducting tube 20 can be mounted within the groove 41 to contact with the two first tube guides 40, thereby enlarging the contact area between the heat-conducting tube 20 and the foundation board 11.

Because the fins 14 are connected with the lamp holder 13, heat generated by the LED bulbs and the components required by the LED bulbs can be conducted to the fins 14 through the lamp holder 13. Also because the heat-conducting tube 20 is attached on the rear of the lamp holder 13 and on the rear of the foundation board 11, the generated heat can be conducted to the heat-conducting tube 20 through the lamp holder 13 and further conducted to the fins 14 or radiated through the heat-dissipation holes 33. Heat conducted to the fins and radiated through the heat-dissipation holes 33 is further radiated to the surrounding environment. Since the at least one first tube guide 40 and the second tube guide 40A enlarge the contact area between the heat-conducting tube 20 and the top casing 10, the heat-dissipating efficiency of the heat-conducting tube 20 increases and overheated condition or failure of the LED lamp can be mitigated.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An LED lamp comprising:

a top casing having:

a foundation board having:

a top; and at least one first tube guide formed around and protruding from a perimeter of the foundation board and made of metal;

a lamp holder being hollow, centrally mounted on the top casing, extending toward both a forward direction and a backward direction, and having:

a front;

a rear;

an opening formed through the front of the lamp holder;

a base formed on the rear of the lamp holder and having a rear; and a second tube guide being U-shaped, and formed on the rear of the base;

multiple fins radially formed on and protruding from the front of the foundation board and located around the lamp holder; and multiple LED bulbs mounted in the lamp holder;

a heat-conducting tube being bendable and mounted against one side of each one of the at least one first tube guide and within the second tube guide; and a bottom casing recessed and securely combined with the top casing, and having a rear.

2. The LED lamp as claimed in claim 1, wherein the lamp holder further has multiple heat-conducting blocks mounted on the rear of the base and connected with the second tube guide.

3. The LED lamp as claimed in claim 2, wherein the top casing further has an anti-glare sleeve securely mounted in the opening and on an inner wall of the lamp holder and covered with a coating having a dark color.

4. The LED lamp as claimed in claim 3, wherein the foundation board has:

two first tube guides formed around and protruding from the perimeter of the top casing on a bottom of the foundation board; and a groove formed between the first tube guides for the heat-conducting tube to be mounted within the groove and contact with the two first tube guides.

5. The LED lamp as claimed in claim 4, wherein the lamp holder further has a through hole formed through the base and adapted for wires to pass therethrough.

6. The LED lamp as claimed in claim 5, wherein the top casing further has a peripheral wall formed around and protruding from a perimeter of a front of the top casing; and the fins are formed between the peripheral wall and the opening.

7. The LED lamp as claimed in claim 2, wherein the foundation board has:

two first tube guides formed around and protruding from the perimeter of the top casing on a bottom of the foundation board; and a groove formed between the first tube guides for the heat-conducting tube to be mounted within the groove and contact with the two first tube guides.

8. The LED lamp as claimed in claim 7, wherein the lamp holder further has a through hole formed through the base and adapted for wires to pass therethrough.

9. The LED lamp as claimed in claim 8, wherein the top casing further has a peripheral wall formed around and protruding from a perimeter of a front of the top casing; and the fins are formed between the peripheral wall and the opening.

10. The LED lamp as claimed in claim 1, wherein the top casing further has an anti-glare sleeve securely mounted in the opening and on an inner wall of the lamp holder and covered with a coating having a dark color.

11. The LED lamp as claimed in claim 10, wherein the foundation board has:

two first tube guides formed around and protruding from the perimeter of the top casing on a bottom of the foundation board; and a groove formed between the first tube guides for the heat-conducting tube to be mounted within the groove and contact with the two first tube guides.

12. The LED lamp as claimed in claim 11, wherein the lamp holder further has a through hole formed through the base and adapted for wires to pass therethrough.

13. The LED lamp as claimed in claim 12, wherein the top casing further has a peripheral wall formed around and protruding from a perimeter of a front of the top casing; and the fins are formed between the peripheral wall and the opening.

14. The LED lamp as claimed in claim 1, wherein the foundation board has:

two first tube guides formed around and protruding from the perimeter of the foundation board; and a groove formed between the first tube guides for the heat-conducting tube to be mounted within the groove and contact with the two first tube guides.

15. The LED lamp as claimed in claim 14, wherein the lamp holder further has a through hole formed through the base and adapted for wires to mount therethrough.

16. The LED lamp as claimed in claim 15, wherein the top casing further has a peripheral wall formed around and protruding from a perimeter of a front of the top casing; and the fins are formed between the peripheral wall and the opening.

* * * * *